US005548656A

United States Patent [19]

Weisel

[11] Patent Number: 5,548,656

[45] Date of Patent: Aug. 20, 1996

[54] REMOTE METHOD AND APPARATUS FOR LISTENING TO BIRDS

[76] Inventor: Charles Weisel, 147 Brookfield, Youngstown, Ohio 44512

[21] Appl. No.: 297,175

[22] Filed: Aug. 29, 1994

[51] Int. Cl.[6] ..... H04R 29/00

[52] U.S. Cl. ..... 381/122; 381/124

[58] Field of Search ..... 381/122, 56, 124, 381/153, 155–156, 169; 119/23; 181/129, 136

[56] References Cited

U.S. PATENT DOCUMENTS

| | | | |
|---|---|---|---|
| 3,895,188 | 7/1975 | Ingraham | 381/155 |
| 4,768,613 | 9/1988 | Brown | 181/136 |
| 4,998,282 | 3/1991 | Shishido et al. | 381/124 |
| 5,168,830 | 12/1992 | Deglis | 119/23 |
| 5,239,587 | 8/1993 | Muckelrath | 381/56 |

*Primary Examiner*—Stephen Brinich
*Attorney, Agent, or Firm*—Harpman & Harpman

[57] ABSTRACT

The present invention is directed to the remote sensing and transmitting of nature sounds, especially bird sound and songs. A remotely positioned directional microphone assembly picks up and concentrates the bird sounds and songs and transmit it to a separate location to be amplified and reproduced through a speaker allowing the user to hear the birds from a distant indoor location.

3 Claims, 2 Drawing Sheets

REMOTE METHOD AND APPARATUS FOR LISTENING TO BIRDS

BACKGROUND OF THE INVENTION

1. Technical Field

The present invention relates to an improvement in capturing nature's sounds, such as bird songs from a remote location and transmitting the sounds to a listening device within a structure or the like.

2. Description of Prior Art

Prior art devices of this type have relied on a variety of different sound enhancing structures such as parabolic dishes that are commonly used with microphones and amplifiers to enhance and improve the sound gathering capability of the user. These types of devices are often seen at sporting events to hear the play action on the field for television and radio use. Other typical uses of parabolic dishes and microphones are in clandestine surveillance to listen to human conversations unobserved from a distance. Naturalists also use parabolic listening devices to track and record wildlife sounds. Other examples of sound enhancing configurations are illustrated in U.S. Pat. Nos. 5,239,587, 5,168,830 and 4,768,613.

In U.S. Pat. No. 5,239,587 a sound recording device for use by hunters is disclosed wherein a unattended recording of game animal sounds is used to attract game by use of a self-contained recording and playback device in a single self-contained apparatus.

U.S. Pat. No. 5,168,830 is directed to a method for listening to birds by placing a microphone on a bird house or bird feeder and transmitting the bird sounds to a receiver and speaker in a remote location.

U.S. Pat. No. 4,768,613 discloses a bi-directional hearing enhancement device that is worn by the user having a pair of reflecting "ears" that are positioned behind the user's own ears to enhance the sound gathering area of the human ear.

SUMMARY OF THE INVENTION

A bird song and sound gathering and amplifying method to provide a remote sensing and transmission of bird sounds from a distance. Transmitting the captured sounds to a second preferably indoor location and amplifying the sounds to present it to the listener through speakers.

DESCRIPTION OF THE PREFERRED EMBODIMENT

Figure 1:
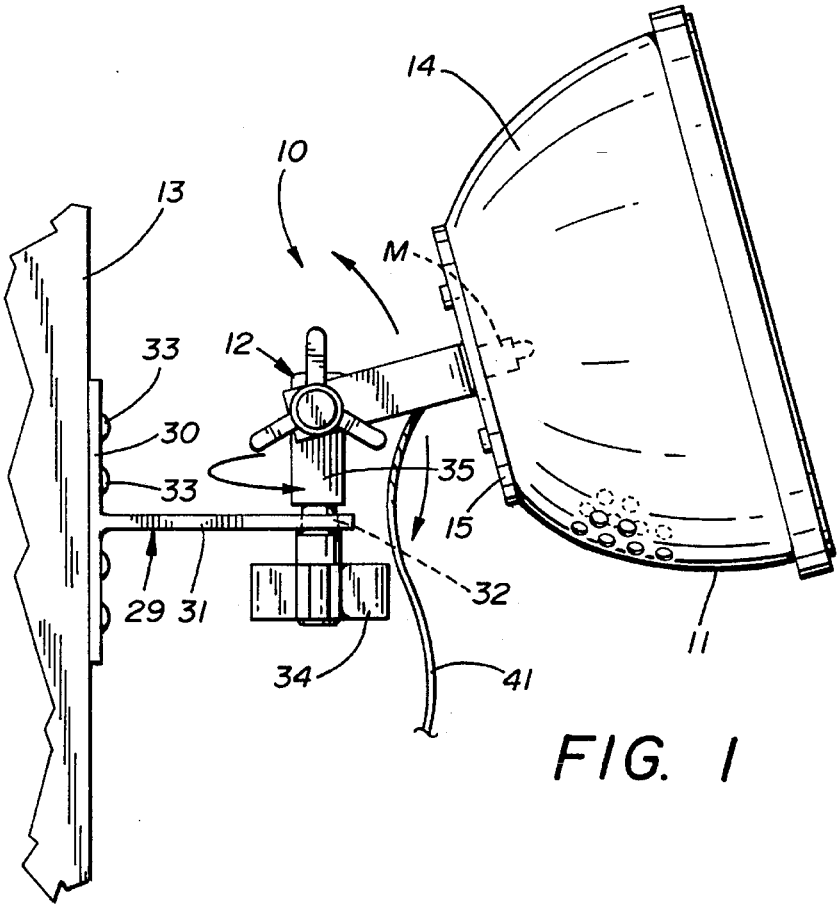
FIG. 1 is a side plan view showing a sound gathering dish and microphone positioned on a support wall.
Figure 3:
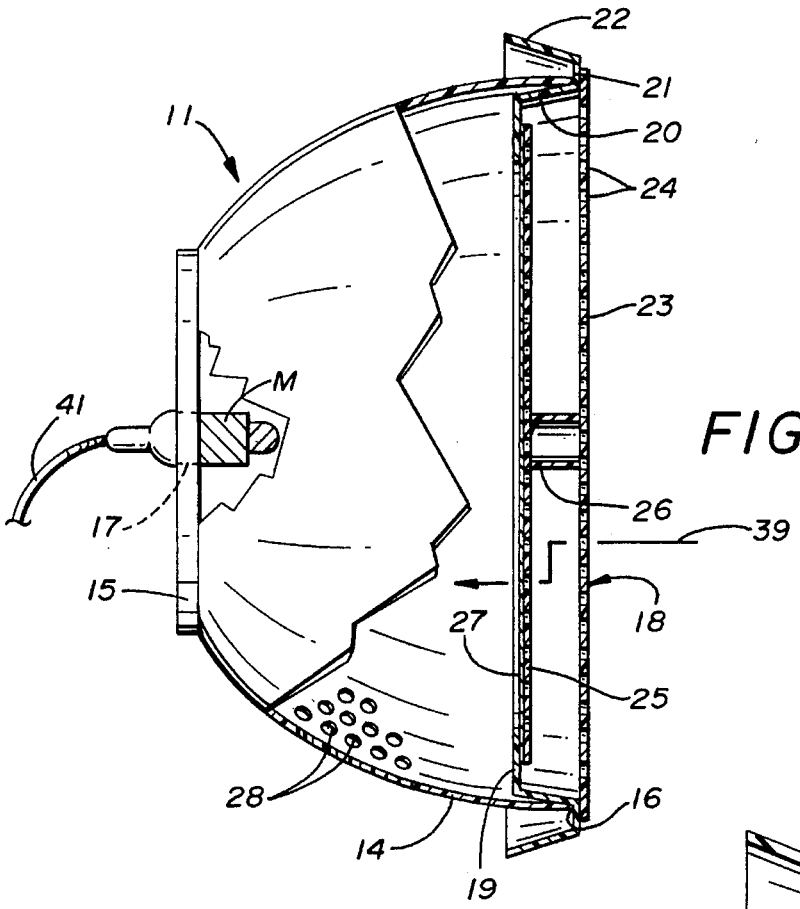
FIG. 3 is an enlarged side plan view of the sound gathering apparatus of FIG. 1 independent of its mounting structure with portions broken away illustrating the microphone and dish structure relationship.
Figure 4:
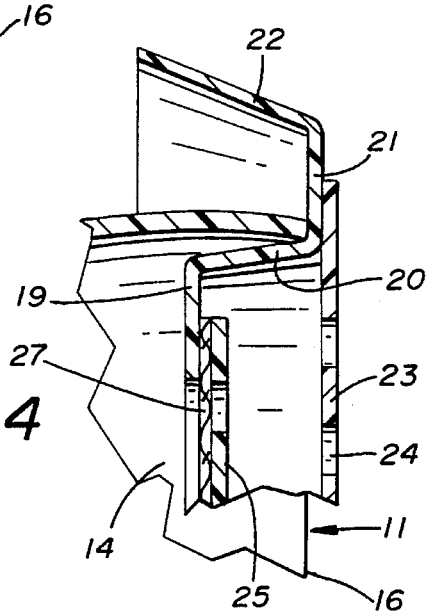
FIG. 4 is an enlarged partial cross-sectional view of the dish of the invention.

A sound gathering assembly 10 can be seen in FIGS. 1, 3, and 4 of the drawings, having a dish 11 with an adjustable mounting bracket assembly 12 extending therefrom secured to a wall 13. The dish 11 has an annular curved sidewall 14 integral with a transversely flat bottom portion 15. The sidewall 14 has an annular lip edge 16 opposite said bottom portion 15 defining a central opening therebetween. Referring to FIGS. 3 and 4 of the drawings, the lip edge 16 defines a mounting area for a weather closure 18 having an annular base portion 19 with an upstanding wall 20 extending to a secondary base portion 21 at right angles thereto. An outer angularly disposed annular wall 22 extends downwardly from said secondary base portion 21 defining the annular base portion which is inserted onto the lip edge 16 as clearly illustrated in FIG. 3 of the drawings.

A first weather disk 23 is secured to and around the secondary base portion 21 enclosing the area defined within. The first weather disk 23 has a plurality of spaced apertures within at 24 to allow for the passage of natural sound therethrough. A secondary apertured weather disk 25 is secured to and around the annular base portion 19 as hereinbefore disclosed with said first weather disk 23. A spacer element 26 is positioned between said respective first and second apertured weather dishes 23 and 24 to maintain the same in spaced relation to one another, best seen in FIG. 3.

A sound transparent cloth 27 is affixed to one side of the secondary weather dish 25 to provide an acoustical buffer as will be well understood by those skilled in the art.

The opening 17 in the bottom portion 15 has a condenser microphone M positioned within so as to be upstanding from the transversely flat bottom portion 15.

The annular sidewall 14 has a plurality of spaced drainage apertures at 28 which are spaced inwardly from the bottom portion 15 to provide moisture drainage when in use as will be discussed in greater detail later.

Figure 2:
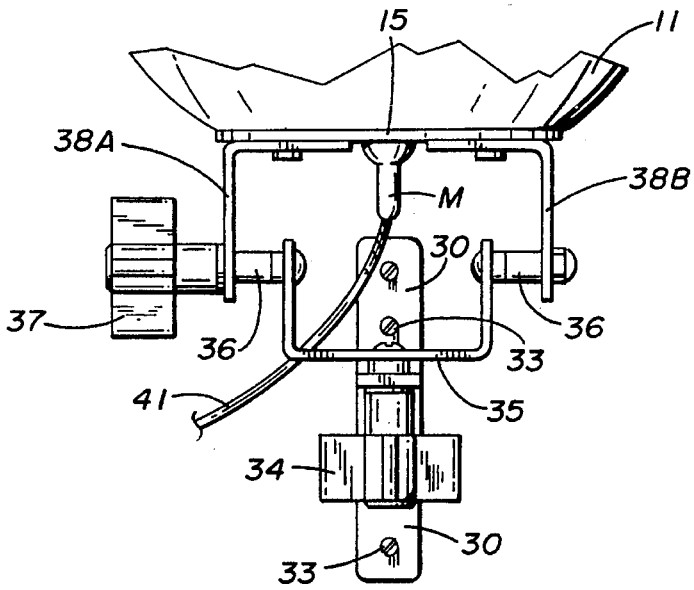
FIG. 2 is an enlarged front plan view of the sound gathering dish and mounting assembly with portions broken away.

Referring now to FIGS. 1 and 2 of the drawings, the adjustable mounting bracket assembly 12 can be seen comprising a T-shaped wall attachment bracket 29 having mounting elements 30 and a dish support leg 31 extending at right angles to said mounting elements 30 and which is apertured at 32 adjacent its free end thereof. The mounting elements 30 have multiple openings therein for securing same to the wall 13 by a plurality of fasteners 33.

An adjustable screw knob assembly 34 (well understood by those skilled in the art) extends through said aperture 32 and adjustably secures a U-shaped base dish support bracket 35 having apertures in its free end respectively with spacers 36 on threaded fasteners 36A extending from said support brackets respective apertured free ends. A second adjustable screw knob assembly 37 extends through one of said spacers 36 and adjustably secures an L-shaped mounting bracket 38A thereto. A second L-shaped mounting bracket 38B extends from said remaining apertured free end of the support bracket 35 with said respective L-shaped mounting brackets 38A and B being affixed to the bottom portion 15 of the dish 11 in spaced relation to said condenser microphone M as hereinbefore described providing full adjustable positioning of the dish 11 in both the horizontal and vertical planes in relation to said mounting surface wall 13 as indicated by the directional arrows in FIG. 1 of the drawings.

The assembled dish 11 provides weather protection for the condenser microphone M within through its dual weather disks 23 and 25 so that the direct impact of precipitation thereon will be diffused and diminished by the impingement against the respective apertured weather disks 23 and 25 while still allowing ample natural sounds to be gathered and concentrated by the flat bottom portion 15 of the dish and the sidewall 14 for presentation to the condenser microphone M strategically located in upstanding relation from said flat bottom portion 15 as illustrated by the arrow 39 in FIG. 1.

Figure 5:
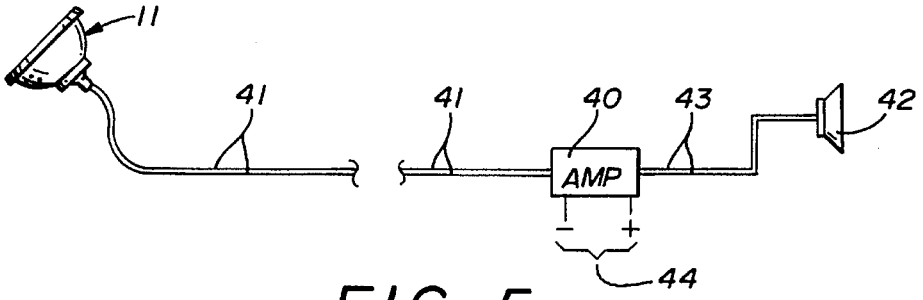
FIG. 5 is a schematic diagram illustrating the system and process of the method in total.

Referring now to FIG. 5 of the drawings, a schematic illustration shows the process of the invention defining the innerconnection of the hereinbefore described assembled dish 11 with an amplification module 40 via transmission lines 41 and attached speakers 42 via separate transmission lines 43. A source of power is indicated at 44 for the amplification module as is well known to those skilled in the art.

The user thus can hear the bird songs through the speaker 42 from a remote indoor location by utilization of the process of the invention as described.

It will therefore be apparent to those skilled in the art that various changes and modifications may be made therein without departing from the spirit of the invention.

Therefore I claim:

1. A method for remote monitoring and listening to bird songs outdoors from a separate location comprising;

a. placing a sound gathering dish outdoors, said sound gathering dish comprises and annular sidewall, a flat bottom portion defining an opening therein, a weather portion closure on said dish comprising an annular base portion, a pair of spaced overlapping apertured disks on said base portion, each of said disks having multiple openings within, a spacer between said disks, a sound diffuser cloth on one of said disks b. securing a microphone within said dish such that said microphone is upstanding from said flat bottom portion and transmits sounds made by the birds to an amplifier receiver at a remote location c. attaching a speaker assembly to said amplifier receiver d. adjustably securing said sound gathering dish outdoors via a mounting bracket e. interconnecting said microphone to said amplifier receiver.

2. The method as set forth in claim 1 wherein said mounting bracket comprises, apertured brackets extending from said flat bottom portion of said dish, a first adjustable screw knob on one of said apertured bracket, a U-shaped bracket extending from said first adjustable screw knob, a wall engagement bracket adjustably secured to said U-shaped bracket by a second adjustable screw knob.

3. The method as set forth in claim 1 wherein interconnecting said microphone to said amplifier receiver comprises, transmission lines extending between said microphone and said amplifier receiver, a source of power for said amplifier receiver and a speaker in communication with said amplifier receiver for reproduction of the bird sounds.

* * * * *